United States Patent [19]

Dalo et al.

[11] Patent Number: 4,637,415

[45] Date of Patent: Jan. 20, 1987

[54] LIGHT SHELTER IN THE FORM OF A TENT COMPRISING A ROOF CONSTITUTED BY A CANVAS

[76] Inventors: Pierre Dalo, 153, rue de Fleury, 92140 Clamart; Jean Dalo, Rue Beaurepaire, 91410 Roinville-sur-Dourdan, both of France

[21] Appl. No.: 690,883

[22] Filed: Jan. 14, 1985

[51] Int. Cl.[4] ..... E04H 15/28; A45B 11/00; A45B 15/00

[52] U.S. Cl. ..... 135/98; 135/20 M; 135/34

[58] Field of Search ..... 135/98, 99, 20 M, 34, 135/36 F, 119, 25 R, 20 R

[56] References Cited

U.S. PATENT DOCUMENTS

| | | | |
|---|---|---|---|
| 641,586 | 1/1900 | French et al. | 135/98 X |
| 988,401 | 4/1911 | Stonebridge | 135/99 |
| 1,033,651 | 7/1912 | Ahern et al. | 135/34 |
| 1,516,372 | 11/1924 | Brooks | 135/98 |
| 1,636,594 | 7/1927 | Dickey | 135/98 |
| 1,801,913 | 4/1931 | Frederick | 135/98 |
| 2,001,196 | 5/1935 | Jost | 135/98 |
| 2,935,074 | 5/1960 | Baker | 135/98 |
| 2,969,074 | 1/1961 | Willis | 135/DIG. 9 |
| 3,161,990 | 12/1964 | Morris, Jr. | 52/63 |
| 3,217,723 | 11/1965 | Suchy | 135/20 R |
| 3,221,756 | 12/1965 | Rupright | 135/98 |
| 3,419,024 | 12/1968 | Nickerson, Jr. | 135/98 |
| 3,570,062 | 3/1971 | Medlin | 135/20 M |
| 3,780,477 | 12/1973 | Sprung, Jr. | 52/63 |
| 4,000,750 | 1/1977 | Becher | 135/16 |
| 4,011,881 | 3/1977 | Becher | 135/20 M |

FOREIGN PATENT DOCUMENTS

| | | | |
|---|---|---|---|
| 2316824 | 10/1974 | Fed. Rep. of Germany | 135/119 |

*Primary Examiner*—Robert A. Hafer
*Assistant Examiner*—D. Neal Muir
*Attorney, Agent, or Firm*—Sandler & Greenblum

[57] ABSTRACT

A light shelter in the form of a tent, comprises a roof constituted by a canvas and a central pole in abutment on the ground and supporting the canvas at its central top. A plurality of tensioning arms whose inner ends are articulated about pins adjacent the pole, are provided for tensioning a cable housed in a hem extending along the lower peripheral edge of the canvas. A removable jack is also provided for varying the distance between the pins for articulation of the tensioning arms and the central top of the canvas. Each tensioning arm is connected, at its outer end, to the lower peripheral edge of the canvas by means of a hook engaged on the cable which freely supports the canvas.

7 Claims, 4 Drawing Figures

LIGHT SHELTER IN THE FORM OF A TENT COMPRISING A ROOF CONSTITUTED BY A CANVAS

BACKGROUND OF THE INVENTION

The present invention relates to a light shelter in the form of a tent comprising a roof constituted by a canvas.

French Pat. No. 2 283 267 already discloses light shelters of this type, comprising a central pole in abutment on the ground and supporting the canvas at its centre top. The central pole of this known type of shelter is constituted by two parts forming a telescopic assembly, namely a lower part of the pole abutting on the ground, bearing pins for articulation of the inner ends of a plurality of arms for tensioning the canvas, and an upper part of the pole mounted to slide vertically in the lower part thereof. The canvas of this type of shelter is in addition rigidly fixed on spokes extending from the top of the roof towards the lower peripheral edge of the canvas. The tensioning arms which are also articulated on the spokes place said spokes, and consequently the canvas, under considerable tension, said canvas bearing, along its lower edge, a cable housed in a hem and which is rigidly fast with this lower edge. This cable also contributes to subjecting the canvas to considerable tension.

To vary the distance between the pins for articulation of the tensioning arms on the lower part of the pole and the central top thereof, mechanical means, in particular a jack fast with the pole, are used. By using these means, the outer ends of the tensioning arms are moved apart and the canvas of the shelter is unfolded, at the same time placing it under a considerable tension.

Heretofore known shelters of this type present several drawbacks.

In fact, the canvas is itself subjected to considerable tension, which brings about rapid deterioration, all the more so as it is subjected, by the very nature of its use, to bad weather and to intense sunshine, which weakens it and reduces its resistance. Furthermore, as the mechanical means provided for unfolding the canvas are permanently fast with the pole, they must necessarily be provided for each shelter, this rendering the latter complex and expensive.

SUMMARY OF THE INVENTION

It is an object of the present invention to overcome these drawbacks.

To this end, this light shelter in the form of a tent, comprising a roof constituted by a canvas, a central pole in abutment on the ground and supporting the canvas at its central top, a plurality of tensioning arms whose inner ends are articulated about pins adjacent the pole, these arms tensioning a cable housed in a hem extending along the lower peripheral edge of the canvas, and a jack for varying the distance between the pins for articulation of the tensioning arms and the central top of the canvas, is characterized in that each tensioning arm is connected, as its outer end, to the lower peripheral edge of the canvas by means of a hook engaged on the cable which freely supports the canvas.

According to a further feature of the invention, the jack with which the shelter is provided is removable.

The shelter according to the invention offers the advantage that the canvas forming the roof is no longer strongly tensioned, only the cable being subjected to considerable tension. Furthermore, the canvas is not tensioned on spokes: in fact, it is merely supported freely by the cable, and even has the possibility of sliding lightly thereon. It is therefore spared the detrimental effects of this tension.

Furthermore, as the jack with which this shelter is provided is removable, as soon as the shelter is unfolded, it may be detached and used for another shelter. The jack thus is not a part of the structure when the shelter is folded into a substantially vertical position. A considerable saving of equipement is thus made and if a jack is defective, another may easily replace it.

BRIEF DESCRIPTION OF THE DRAWINGS

The invention will be more readily understood on reading the following description with reference to the accompanyng drawings, in which.

DESCRIPTION OF THE PREFERRED EMBODIMENTS

Figure 1:
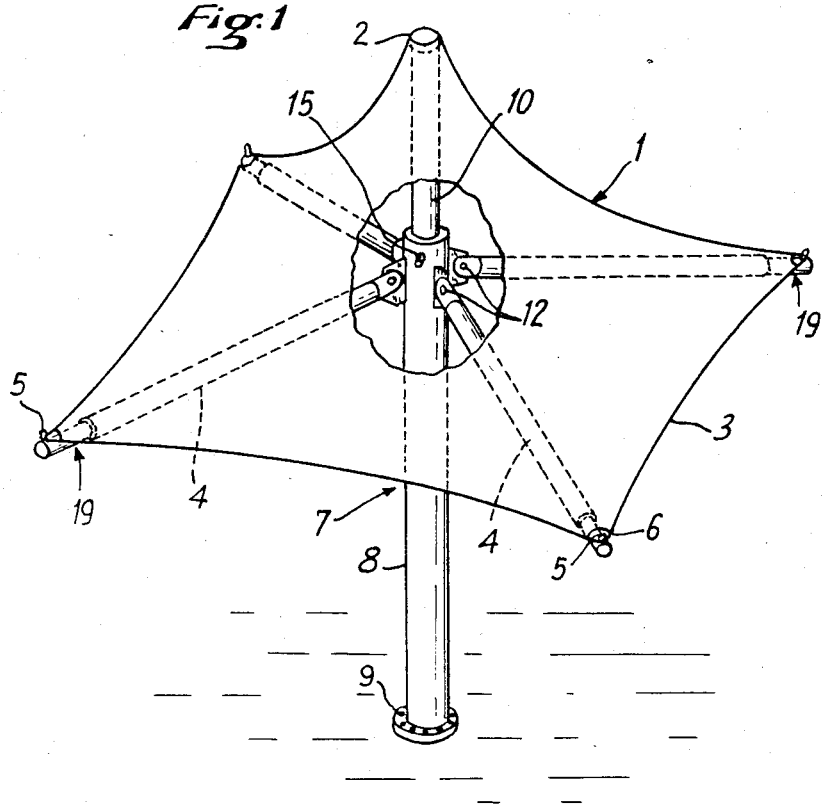
FIG. 1 is a perspective view of a light shelter in the form of a tent with a sole central pole.
Figure 2:
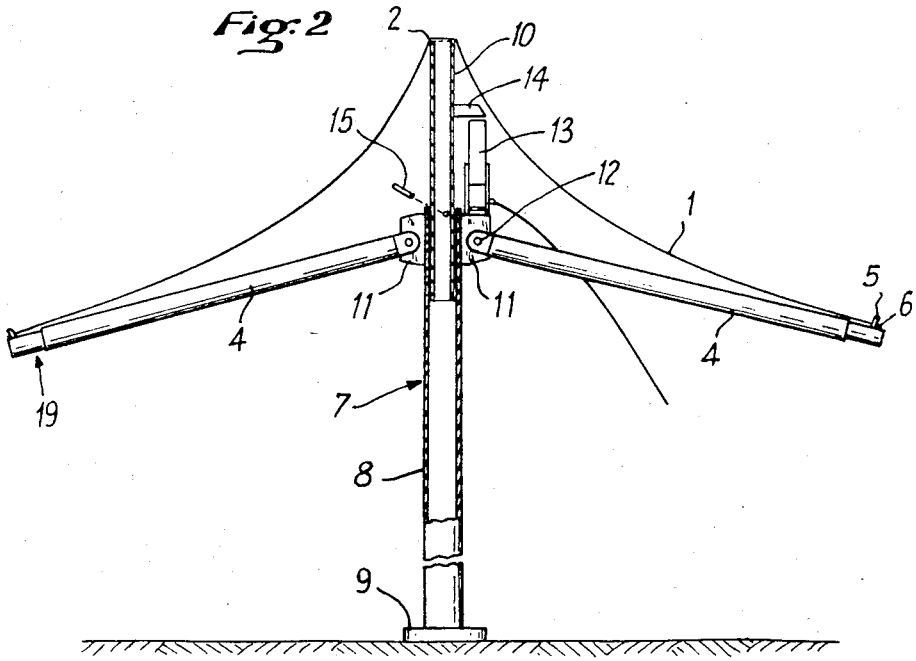
FIG. 2 is a vertical longitudinal sectional view of the light shelter shown in FIG. 1.
Figure 2A:
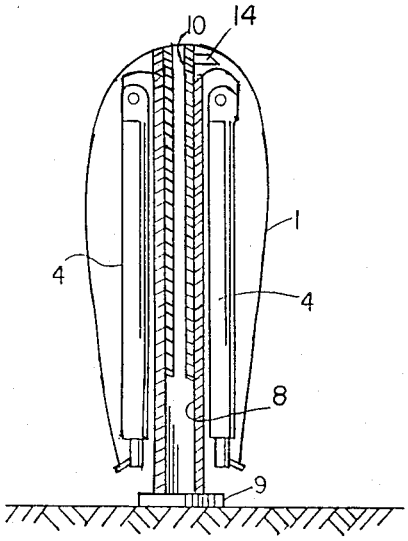
FIG. 2*a* is a similar view of the shelter in the folded position.

Referring now to the drawings, the light shelter according to the invention, shown in FIGS. 1 and 2, comprises in its upper part a canvas 1 whose central top 2 is elevated with respect to the lower peripheral edge 3 of the canvas. A plurality of tensioning arms 4 are distributed regularly about the vertical axis of the light shelter. Each tensioning arm 4 is connected, at its outer end, to the lower peripheral edge 3 of the canvas 1, by means of a hook 5 which is engaged on a cable 6 housed in a hem extending along the lower peripheral edge 3 of the canvas 1.

The support of the canvas 1 forming the roof of the light shelter is constituted by a central pole 7 which, in this particular embodiment of the invention, is made in two parts forming a telescopic assembly. The pole 7 comprises a lower tubular part 8 in abutment on the ground, at its lower end, via a sole plate 9 and in which slides the upper part 10 of the pole, likewise tubular and whose outer diameter corresponds to the inner diameter of the lower part 8. The lower part 8 of the pole 7 which is in abutment on the ground, bears at its upper end vertical outer bearing plates 11 on which the inner ends of the tensioning arms 4 are articulated about respective horizontal pins 12.

The canvas 1 is unfolded by means of a removable jack 13 which is mounted, to this end, between a stop 14, fast with the upper sliding part 10 of the pole 7, and a bearing fast with the upper end of the lower part 8 of the pole, this bearing being constituted, for example, by one of the vertical bearing plates 11. As may be seen more particularly in FIG. 2, the body of the jack 13 is in abutment on a vertical bearing plate 11 whilst its rod 13 which extends upwardly, abuts beneath stop 14. It will readily be appreciated that, when the jack 13 is supplied from the bottom, the extension of its rod causes elevation of the stop 14 and the upper part 10 of the pole 7 which slides upwardly inside the fixed tubular lower part 8. The central top 2 of the canvas 1 is thus driven upwardly, this provoking, via the canvas 1 and the cable 6, a pivoting movement of the tensioning arms 4; while all of the tensioning arms move in a generally upward pivoting motion, some can be considered counter clockwise and others clockwise, dependent upon the perspective of a viewer towards the horizontal position. Consequently, the lower peripheral edge 3 of the canvas 1 is pushed progressively outwardly and the canvas 1 is unfolded.

When the desired unfolding is obtained, the upper part 10 of the pole 7 is immobilized by any appropriate means with respect to its lower part 8. Such immobilization may be effected for example by means of a locking pin 15 introduced transversely through holes pierced, in the appropriate positions, in the two parts 8 and 10 of the telescopic pole 7.

Figure 3:
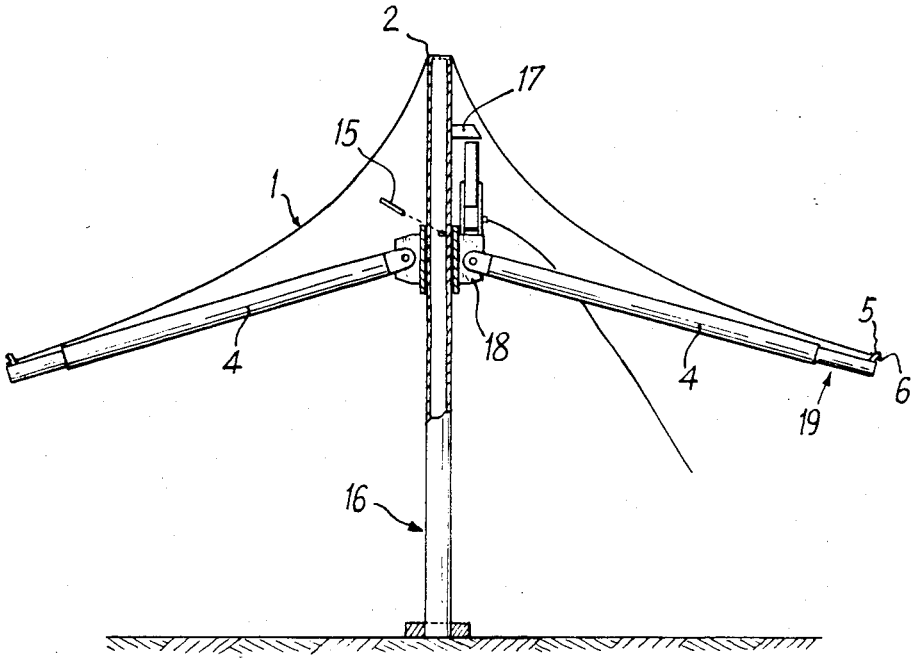
FIG. 3 is a vertical longitudinal sectional view of a variant embodiment.

In the variant embodiment illustrated in FIG. 3, the single central pole 16 is constituted by one tubular piece whose upper end supports the central top 2 of the canvas 1. A stop 17 is fast with the upper part of the one-piece tubular pole 16, and it is therefore fixed. Furthermore, the pins 12 for articulation of the tensioning arms 4 are borne by vertical bearing plates 11 which are fast with a sleeve 18 mounted to slide vertically on the one-piece pole 16. The canvas 1 is unfolded, as in the case of the embodiment shown in FIGS. 1 and 2, by means of the removable jack 13 which abuts on the one hand beneath the stop 17 and on the other hand on the sleeve 18, in order to move them apart from each other and to unfold the canvas 1, when this jack 13 is supplied from the bottom. The sleeve 18 may be immobilized on the pole 16 by means of a locking pin 15 engaged through holes pierced in the tubular pole 16 and the sliding sleeve 18.

What we claim is:

1. A shelter such as a tent, said shelter comprising a canvas and a pole having first and second ends, a stationary pole member and movable pole member, said stationary pole member adapted to be supported upright on a substantially horizontal surface, said movable pole member supporting said canvas along a central portion of said canvas, a plurality of substantially vertically arranged bearing plates attached to said pole about the periphery of said pole, a plurality of tensioning arms extending outwardly from said pole and being attached to respective ones of said vertical bearing plates, said canvas having a peripheral portion in the form of a hem and having a cable positioned within said hem about the peripheral portion of said canvas, a generally vertically disposed jack being removable and separably supported by one of said vertical outer bearing plates, said shelter further comprising a stop extending substantially radially outwardly from the periphery of said pole and above said jack, said jack comprising means for articulating said tensioning arms and said canvas about said pole by elevating said stop and the movable pole member, each of said tensioning arms having a first end attached to a respective one of said bearing plates and a second outer end attached to said peripheral canvas portion by a hook which is attached to said cable, said shelter having a closed position in which said arms are substantially vertical and said jack is removed from said support, and an open position in which said arms are substantially horizontal, said jack being extensible in a generally upwardly vertical fashion into abutment with said stop to move said stop and said moveable pole member upwardly, wherein said jack, said stop and said moveable pole member together comprise means for raising said arms upwardly into said substantially horizontal position, said shelter further comprising means for maintaining said peripheral portion of said canvas and said arms in a substantially horizontal position when said shelter is in said open position.

2. A shelter in accordance with claim 2 wherein said sleeve and said stationary pole member both include apertures, said shelter further comprising a pin which is adapted to be positioned transversely in said apertures to immobilize said sleeve on said stationary pole member.

3. A shelter in accordance with claim 1 wherein said pole comprises two tubular members, a stationary lower tubular member having a first end abutting said support surface and a second, slidable upper member telescopically positioned within said first tubular member, said shelter further comprising pins for articulating said arms to said vertical bearing plates.

4. A light shelter in accordance with claim 3 further comprising a pin, wherein said slidable upper member of said pole and the stationary lower pole member can be immobilized by inserting said pin into apertures in said upper and lower pole members.

5. A light shelter in accordance with claim 1 wherein said arms are pivotably connected to said vertical bearing plates.

6. A shelter such as a tent, said shelter comprising a canvas and a pole having first and second ends, said pole comprising a stationary pole member and a moveable pole member in the form of a sleeve slidably positioned about the outer surface of said stationary pole member, said stationary pole member adapted to be supported upright on a substantially horizontal surface, said stationary pole member comprising means for supporting a central portion of said canvas, a plurality of substantially vertically arranged bearing plates being mounted on said sleeve and being adapted to slide vertically with respect to said stationary pole member when said slidable member slides along said pole, a plurality of tensioning arms extending outwardly from said pole and being pivotably attached to respective ones of said vertical bearing plate, said canvas having a peripheral portion in the form of a hem and having a cable positioned in said hem about the peripheral portion of said canvas, a generally vertically disposed jack being removably and separably supported by one of said generally vertically arranged outer bearing plates, each of said tensioning arms having a first end attached to a respective one of said bearing plates and a second, outer end attached to said peripheral canvas portion by a hook which is attached to said cable, said shelter having a closed position in which said arms are substantially vertical and in which said removable jack is not positioned on one of said bearing plates and an open position in which said arms are substantially horizontal, said shelter further comprising a stop extending substantially radially outwardly from said stationary pole member above said jack and said bearing plates, said jack being extensible in a generally vertical fashion so as to comprise means for moving said slidable member downwardly along said stationary pole member after said jack abuts said stop, said shelter comprising means for maintaining said peripheral portion of said canvas and said arms in a substantially horizontal position when said shelter is in said open position.

7. A shelter in accordance with claim 6, wherein said maintaining means comprises apertures in said slidable pole member and said stationary pole member and a pin which is adapted to be inserted into said apertures when said apertures are aligned to immobilize said slidable pole member.

* * * * *

UNITED STATES PATENT AND TRADEMARK OFFICE

CERTIFICATE OF CORRECTION

PATENT NO. : 4,637,415

DATED : January 20, 1987

INVENTOR(S) : J.DALO et al.

It is certified that error appears in the above-identified patent and that said Letters Patent is hereby corrected as shown below:

On the Cover Page, in the fourth line on the right-hand column, change "3,570,062" to ---3,870,062---; and In column 4, line 3 of the printed patent (i.e., in claim 2, line 1), change "claim 2" to ---claim 1---.

Signed and Sealed this

Fifth Day of April, 1988

*Attest:*

*Attesting Officer*

DONALD J. QUIGG

*Commissioner of Patents and Trademarks*